US006053107A

United States Patent [19]

Hertel et al.

[11] Patent Number: 6,053,107

[45] Date of Patent: Apr. 25, 2000

[54] METHOD AND APPARATUS FOR REGISTERING A PRE-PRINTED WEB ON A PRINTING PRESS

[75] Inventors: James E. Hertel; Roman J. Mudry; David C. O'Donnell, all of Green Bay, Wis.

[73] Assignee: Paper Converting Machine Co., Green Bay, Wis.

[21] Appl. No.: 09/229,918

[22] Filed: Jan. 13, 1999

[51] Int. Cl.[7] ..... B65H 23/04; B65H 23/14; B41F 5/12

[52] U.S. Cl. ..... 101/490; 101/485; 101/220; 101/225; 226/2; 226/27

[58] Field of Search ..... 101/178, 181, 101/180, 220, 229, 138, 135, 481, 490, 485, 225; 226/1, 2, 24, 27–30, 44, 45, 195

[56] References Cited

U.S. PATENT DOCUMENTS 3,949,949 4/1976 Thompson .
4,129,238 12/1978 Herd ..... 226/29
4,452,140 6/1984 Isherwood et al. ..... 101/181
4,485,982 12/1984 St. John et al. ..... 242/57.1
5,224,640 7/1993 Fokos et al. ..... 226/27
5,361,960 11/1994 Fokos et al. ..... 226/2
5,485,386 1/1996 Andreasson .
5,526,107 6/1996 Bronstein ..... 355/319
5,709,331 1/1998 Lam .
5,813,587 9/1998 Nordgren .

OTHER PUBLICATIONS

1994, Paper Converting Machine Company, Product Printing Services Manual–1 page, QRFX411, Dancer Roll System.

*Primary Examiner*—Kimberly Asher

[57] ABSTRACT

A preprinted web having a plurality of first repeating images is reprinted with a plurality of second repeating images which are in register with the first images. A register mark is printed on the web for each of the first images. When the web is reprinted, the positions of the register marks are sensed and compared with the positions of the second images, and the unwind tension of the web is adjusted to maintain the relative positions substantially constant.

12 Claims, 5 Drawing Sheets

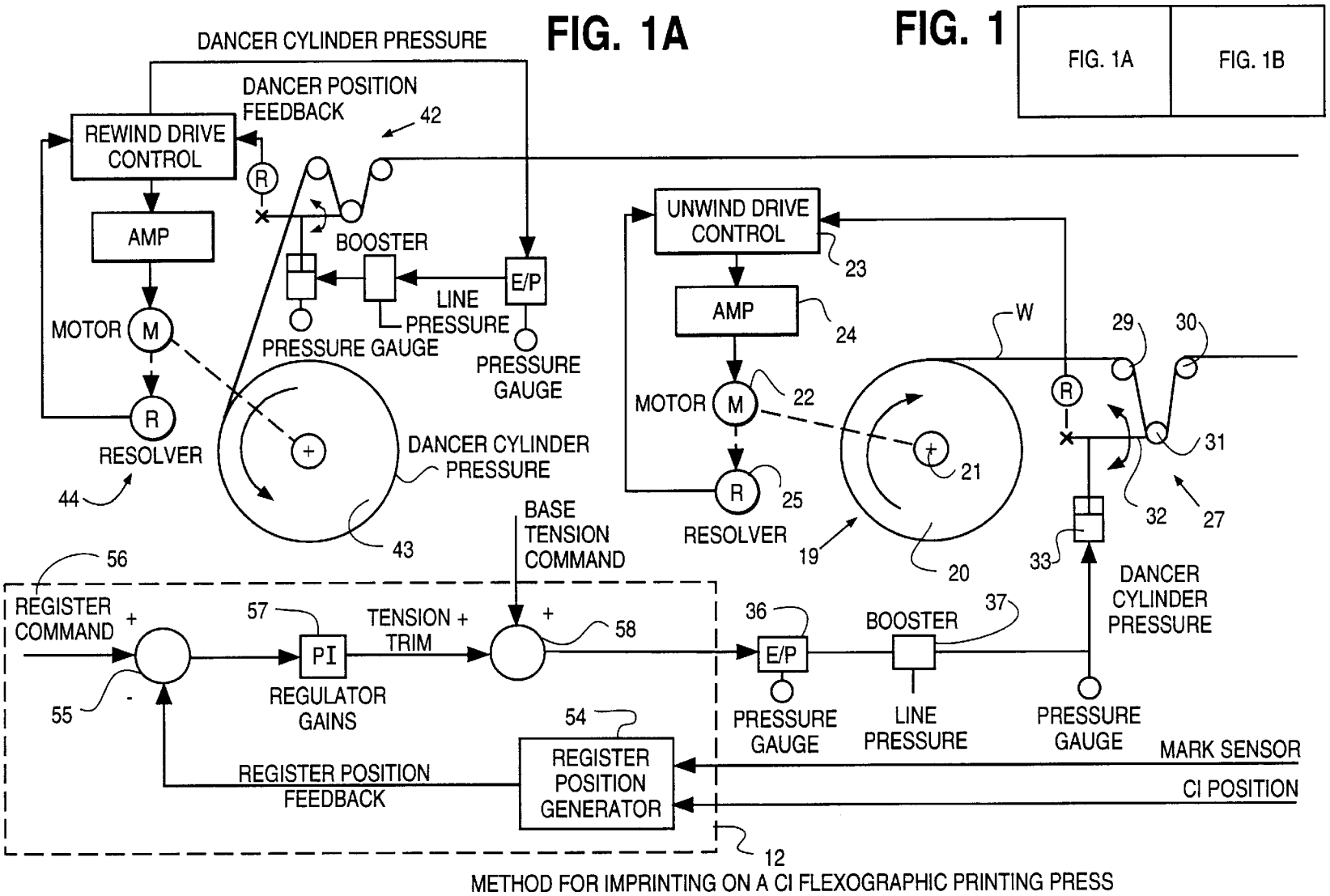
FIG. 1
FIG. 1A
FIG. 1B
UNWIND DRIVE CONTROL
AMP
MOTOR
RESOLVER
DANCER CYLINDER PRESSURE
PRESSURE GAUGE
BOOSTER
LINE PRESSURE
E/P
MARK SENSOR
CI POSITION
W
REWIND DRIVE CONTROL
DANCER POSITION FEEDBACK
BASE TENSION COMMAND
REGISTER POSITION GENERATOR
TENSION + TRIM
REGULATOR GAINS
PI
REGISTER POSITION FEEDBACK
REGISTER COMMAND
METHOD FOR IMPRINTING ON A CI FLEXOGRAPHIC PRINTING PRESS

METHOD AND APPARATUS FOR REGISTERING A PRE-PRINTED WEB ON A PRINTING PRESS

BACKGROUND

This invention relates to the ability to register a pre-printed web to an image currently being printed.

The present invention is primarily aimed at CI (Central Impression) Flexographic printing presses. Although the invention is not limited to such a machine or printing method.

CI Flexographic printing is a printing method commonly used on flexible packaging materials. Presently there is a need in the flexible packaging industry to have high quality print on one side of a web with limited printing on the backside. The backside printing is typically one or two colors for trademarks, register marks, or coupons. Trademarks, register marks, and coupons are not, of course, limitations of this invention but rather specific applications for the invention.

In all present methods of reprinting preprinted webs, the web (material) is either printed in one pass through one machine or requires an extensive amount of downstream equipment added to the printing press. On a CI Flexographic printing press, back side printing (printing on the reverse side of the web) can only be achieved by running a pre-printed web through the press after reversing the web or by adding extra print stations in-line with the CI printing section.

Printing in register to a pre-printed web on a CI Flexographic press is presently achieved by adding equipment between the unwind station and the CI (printing) section of the machine. The additional equipment is typically a web compensating unit, a register controller, and a driven draw roll. This equipment varies the web path distance between the driven draw roll and the print section to adjust register between the preprinted image and the new image.

Another present method is the so-called double-pass press. On this CI printing machine, the web width is less than half the width of the printing press. The material is delivered from the unwind and printed with the material aligned to one side of the press. This is the first pass. After going through the dryer section, the material is turned over and run on the other side of the machine (parallel to the first pass). This is the second pass. The material again goes through the dryer and to the rewind.

In-line printing with a CI printing press requires an additional print section, a compensating unit (web or cylinder), a register controller, and driven draw roll. Depending on the machine configuration, a web turning bar assembly is also needed to allow backside printing.

The limitation of the present art is the ability to print limited colors or images on the backside of the full web width of flexible packaging which is typically printed using the CI flexographic process. A CI press physically can not print on the reverse side without running the web for a second pass. This requires the use of additional drive systems, register systems, web compensation units and, typically, additional print stations. Space and cost limitations hamper the application of these technologies.

The present art also has a limited ability to run both extensible and non-extensible web materials.

U.S. Pat. No. 3,949,949 relates to controlling tension of a paperboard container to position a pre-printed stock with a punch press. This patent has the limitation of controlling the rate of feed as opposed to the position of the material. This patent is also limited in scope to non-extensible materials.

U.S. Pat. No. 5,485,386 relates to controlling elongation of a web during a single pass printing process. The system controls repeat length. It is limited by not controlling register during a second pass print run.

U.S. Pat. No. 5,709,331 relates to controlling elongation (repeat length) of a printed material. This method is limited in that it cannot control register of a pre-printed web. The system does not monitor register marks and compare them to press position.

U.S. Pat. No. 5,813,587 relates to registering creases while laminating paperboard. The patent does not allow for registering pre-printed webs. It also does not relate to controlling tension based upon the position of register marks with respect to a print (or other) operation. The patent is also limited to non-extensible materials.

SUMMARY OF THE INVENTION

To solve the foregoing problems, the printed material is run through the CI printing section a second time, thereby allowing the print stations to print on the backside of the web. Register to the front side print is accomplished by manipulating web tension, and therefore repeat size, during the second printing. This is accomplished with the existing drive system of the CI printing machine with minimal extra equipment. The invention utilizes the existing dancer assembly, drive system, and controller of the CI press. The additions may be as minor as a color contrast detector (eye) to detect a pre-printed register mark, and software changes to the drive system. The overall machine size need not be changed to add the backside printing feature. The minimal changes also allows printing of both sides of the web at a lower cost compared to present art.

DESCRIPTION OF THE DRAWING

The invention will be explained in conjunction with an illustrative embodiment shown in the accompanying drawing, in which FIG. 1 illustrates the relationship between FIGS. 1A and 1B;

FIGS. 1A and 1B are schematic diagrams of a Flexographic printing press which has been modified in accordance with the invention;

DESCRIPTION OF SPECIFIC EMBODIMENT

Figure 1B:
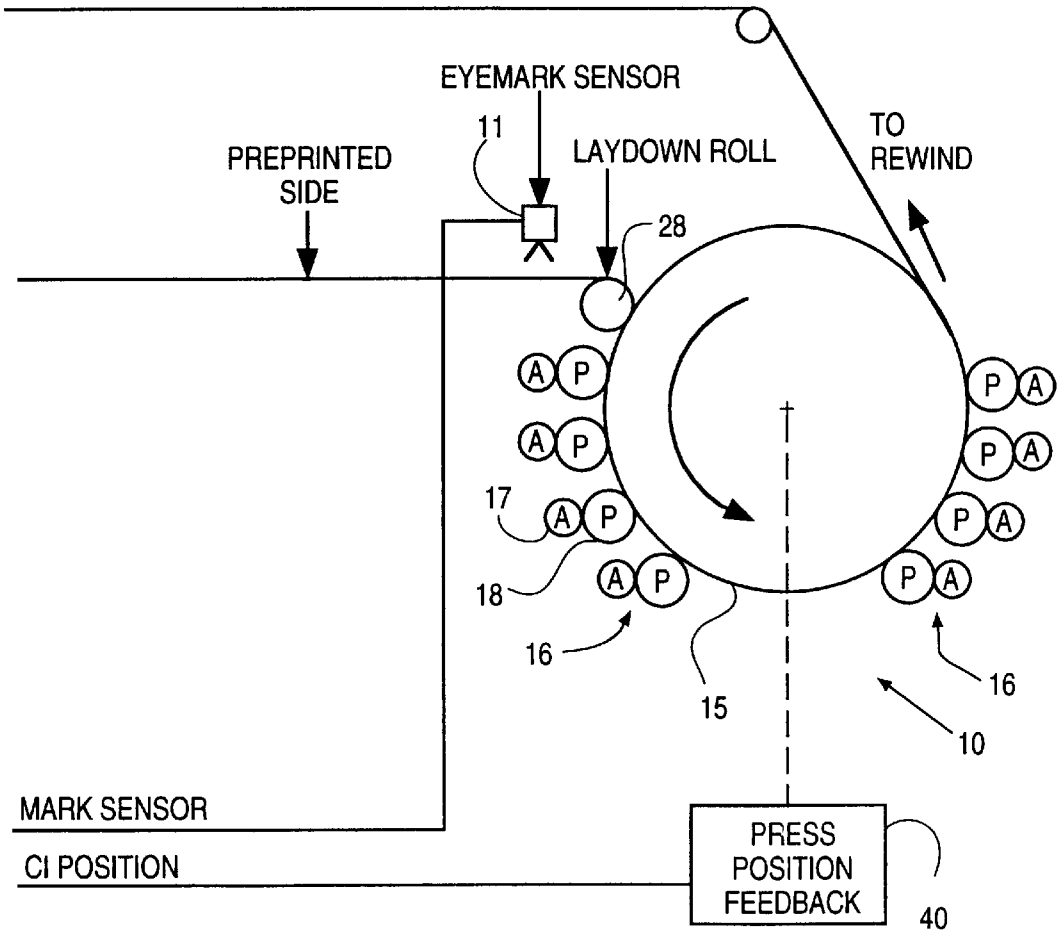

A Flexographic press 10 is illustrated in FIG. 1. As will be explained hereinafter, with the exception of eyemark sensor 11, the structure outside of the dotted line box 12 is conventional. The box 12 represents software for the microprocessor which controls the Flexographic press.

The Flexographic press 10 includes a central impression (CI) drum 15 which is rotatably mounted in a pair of side frames (not shown). The particular press illustrated in FIG. 1 includes eight color decks 16 which are mounted on the frames. Each color deck includes an anilox roll 17 and a plate cylinder 18 for applying ink to a web W transported on the surface of the rotating CI drum 15.

The web is unwound from an unwind apparatus 19 on which a roll 20 of web material is mounted. The roll is mounted on a spindle 21 which is axially driven by a motor 22 which is controlled by an unwind drive control 23 and an amplifier 24. A resolver 25 provides feedback to the unwind drive control 23.

The web is advanced from the unwind 20 through a dancer assembly 27 and over a laydown roll 28 to the CI drum 15. The dancer assembly 27 includes idler rolls 29 and 30 which rotate on fixed axes and a dancer roll 31 which is rotatably mounted on a pivot arm 32. A pneumatic cylinder 33 adjusts the force on the pivot arm 32 which subsequently controls web tension.

Figure 2:
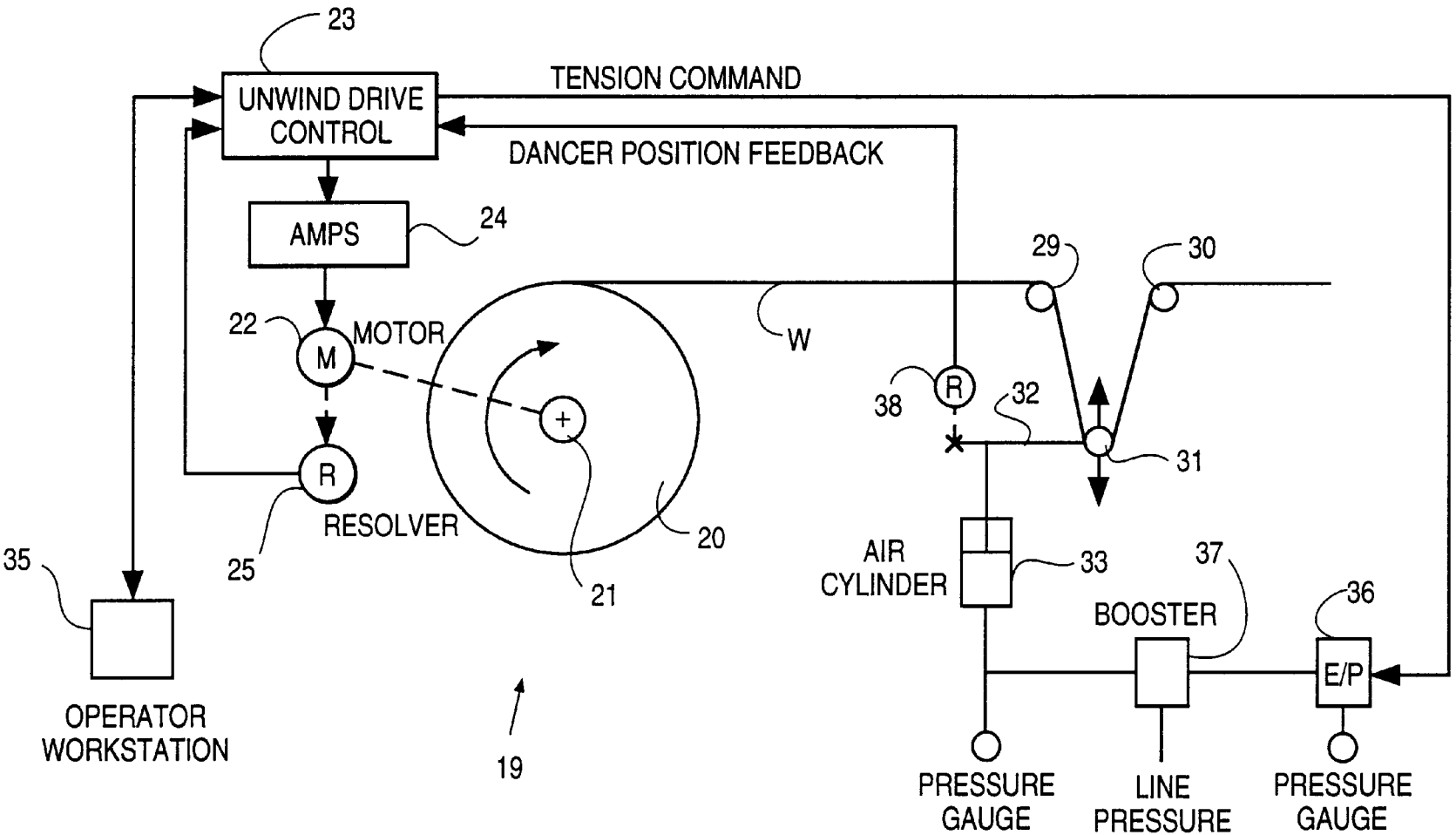
FIG. 2 PRIOR ART
FIG. 2 is a schematic diagram of a conventional unwind and dancer assembly for controlling the tension of the web.

FIG. 2 illustrates the conventional dancer assembly of FIG. 1. The unwind drive control 23 processes signals representing web speed, rotational speed of the spindle 21, and the position of the dancer roll 31. From this information the drive controller provides a signal to the drive amplifier (AMP) 24. This signal controls the motor's 22 speed. The tension for the web is entered by the operator at an operator interface or work station 35. From this information the drive controller provides a signal to the voltage-to-pressure (E/P) converter 36. The pressure signal output of the E/P converter 36 is applied to air pressure booster 37 to control the air pressure which is applied to pneumatic cylinder 33 which is connected to the pivot arm 32. The force of the pneumatic cylinder 33 maintains the desired web tension. Precise tension control is assured because the applied air pressure and the resultant web tension are directly proportional to the drive controller output signal. The position of the dancer roll 31 is read by resolver 38 and fed back to the drive controller.

Each of the color decks 16 can imprint the web with a different color, and the press illustrated in FIG. 1 is capable of printing an image having eight different colors. The portion of the image which is imprinted by each of the plate cylinders 18 is repeated during every revolution of the plate cylinder, and the repeat length of the printed image is defined by the circumference of the plate cylinders.

The CI drum 15 is driven by a servo motor (not shown), and the position of the CI drum 15 as it rotates is read by a press position feedback device 40. Since the CI drum 15 is geared to the plate cylinders 18, the press position feedback also provides information on the position of the plate cylinders 18 and the position of the repeat.

The Flexographic press conventionally includes between color dryers (not shown) between the color decks 16 and a tunnel dryer (not shown) downstream from the CI drum 15 for drying the ink on the web. The dryers are omitted from FIG. 1 for clarity of illustration. The Flexographic press also includes a set of cooling rolls (not shown) between the CI drum 15 and the rewind apparatus 44. The cooling rolls, located after the tunnel dryer, cool the web to minimize the yielding of the extensible webs, which adversely affects tension control of the web. The cooling rolls are driven by a dedicated motor and drive (not shown) and provide a direct means of web tension control. The cooling rolls are omitted from FIG. 1 for clarity of illustration.

The printed web passes from the tunnel dryer through a rewind dancer assembly 42, which is identical to the unwind dancer assembly 27. The printed web is wound onto a roll 43 on a rewind apparatus 44. The tension on the web as it is rewound is controlled by the rewind dancer assembly 42 in the same manner as the tension is controlled during unwinding.

Figure 3:
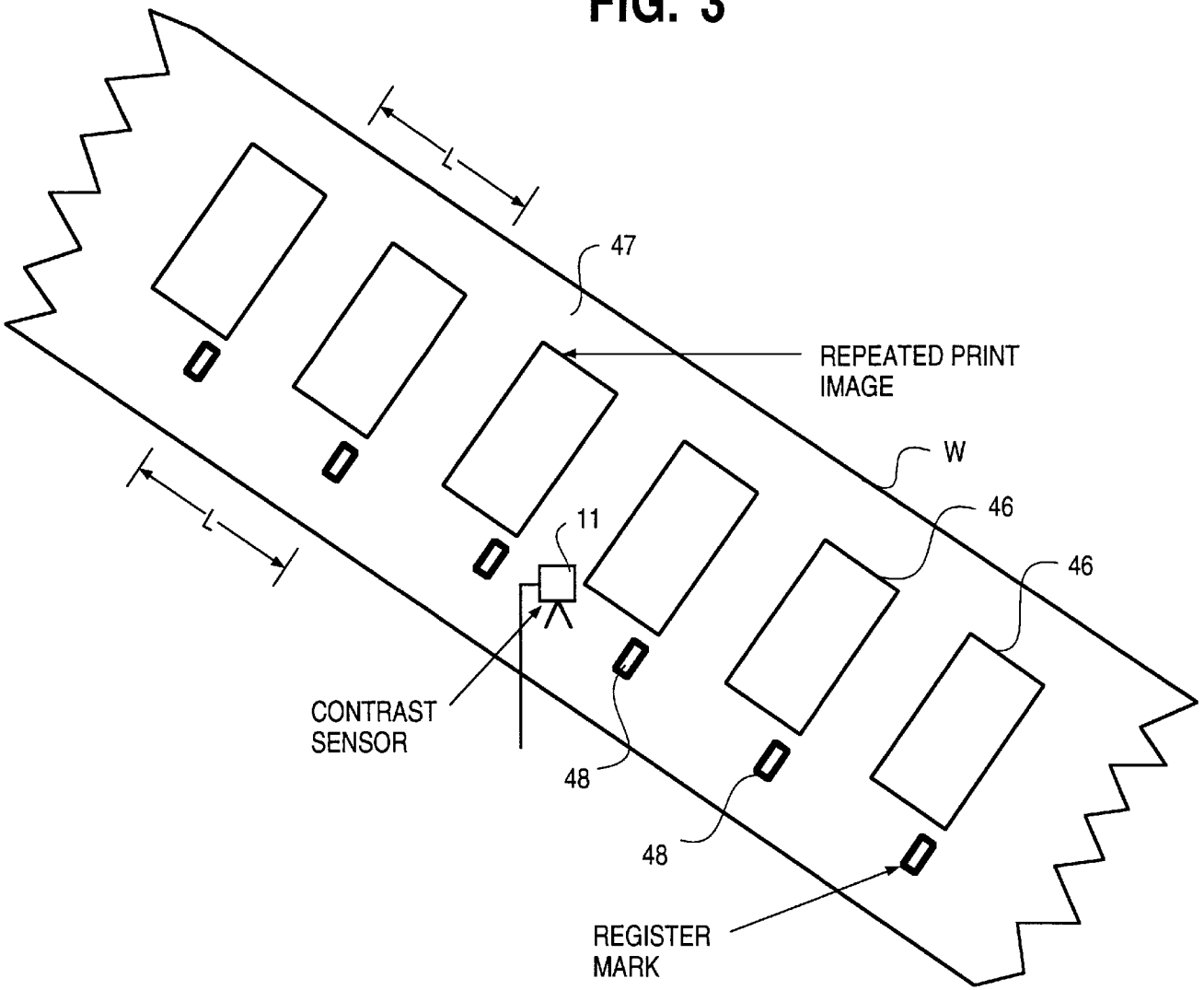
FIG. 3 illustrates the first printed side of the web.

FIG. 3 illustrates a web W after it is printed in a first pass through the Flexographic press 10. A plurality of repeating images 46 are printed on one side 47 of the web. The images 46 are printed at intervals which are defined by a repeat length L. One of the plate cylinders also prints a plurality of register marks 48 which are also printed at intervals which have a repeat length L.

Figure 4:
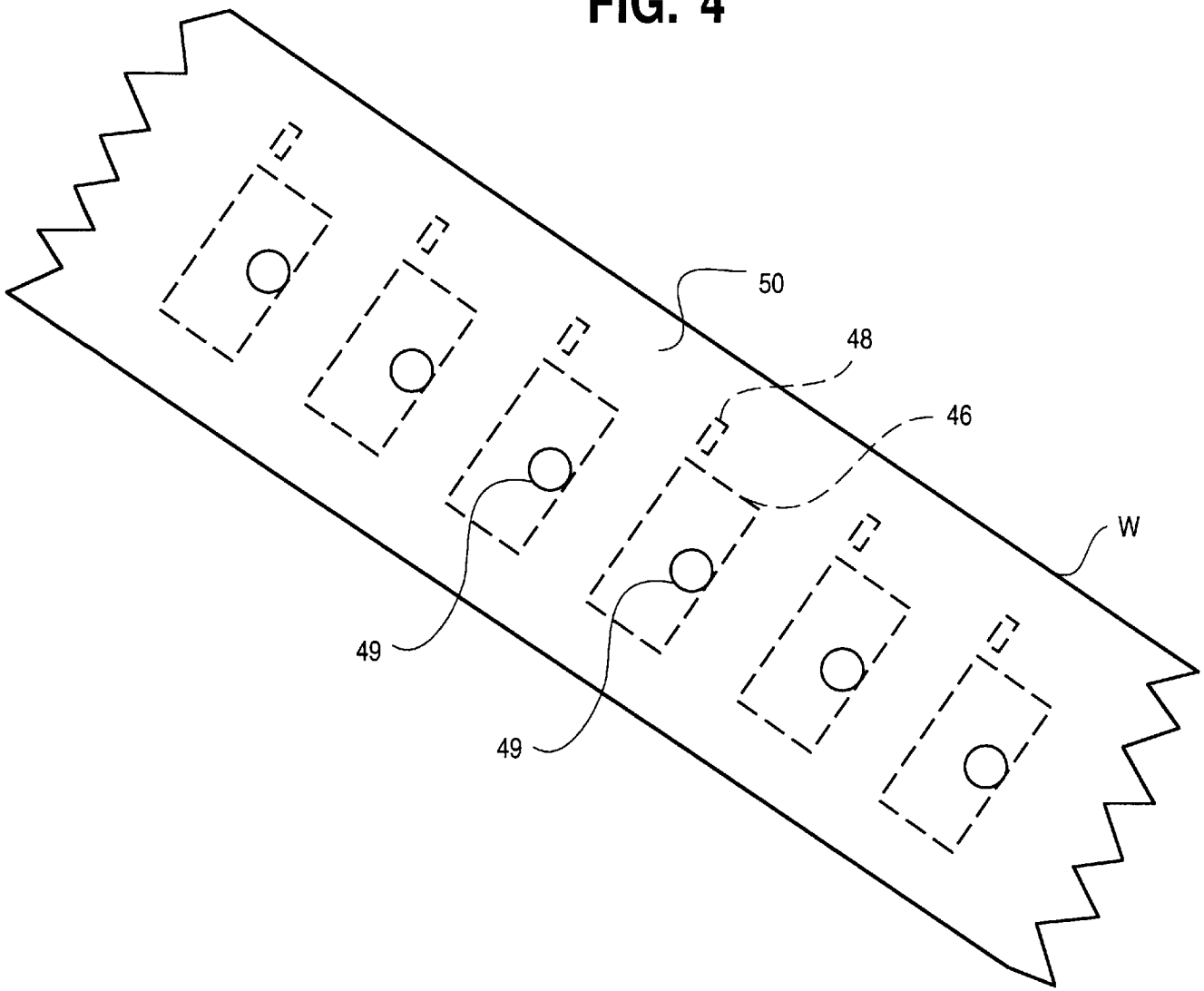
FIG. 4 illustrates the second printed side of the web.

After the first side 47 of the web is printed, the plate cylinders are changed to print the second side of the web. The roll of previously printed web is moved from the rewind 44 to the unwind 19, and the web is unwound so that the first side 47 faces up as indicated in FIG. 1. After the web passes the laydown roll 28, the first side contacts the surface of the CI drum and the second side, or backside, faces the plate cylinders. A second set of repeating images 49 (FIG. 4) are printed on the second side 50 of the web.

The web material is extensible, and during the first printing operation, the web is printed while it is stretched slightly due to the web tension. If the web is allowed to relax, the repeat length shrinks somewhat, commonly referred to as snap back.

The invention provides registration between the first printed images 46 and the second printed images 49 by using the unwind dancer assembly 27 to adjust the tension in the web so that the two images, on opposite sides of the web, are maintained in register. The relaxed repeat length of the first printed images 46 are typically shorter than the repeat length of the second images 49 during the second printing so that the relaxed repeat of the preprinted images 46 can be stretched as needed to match the repeat of the second images 49 and therefore print register.

The relationship between web tension, T, and the rate of register change, dR/dt, can be expressed as:

$$\frac{dR}{dt} = \Delta T * \frac{V_w}{E * A}$$

Where:

R is register (inches)

t is time (sec.)

ΔT is the change in tension (lbf)(pounds force)

$V_W$ is the velocity of web (in./sec.)

E is the modulus of elasticity (lbf/in.$^2$)

A is the cross sectional area of the web (in.$^2$)

As will be explained hereinafter, register is manipulated through a PI (proportional-integral) regulator to command a tension trim to the unwind dancer assembly 27. PI regulation is used on register error to establish an integrated trim value to compensate for errors in the base tension which is set by the operator. This allows the system to match repeats should repeat size change during the unwinding of the web being processed.

Before the second printing operation, the operator sets the base tension for the unwind dancer assembly 27 at the operator workstation 35 (FIG. 2). This is the base tension command. The operator then starts printing the second side (unprinted side) of the web without registering the second side to the first side. Initial register is obtained by rotating the plate cylinders relative to the web by using the conventional stepper motors (not shown) which control the positions of the plate cylinders 18. During the step of obtaining initial register, the images on both sides of the web can be viewed by using a conventional video camera (not shown), or other means, which simultaneously displays both sides of the web. Initial register can also be obtained by visually observing both images if the web is not opaque, or by printing a series of repeats and observing the degree of misregistration by looking at both sides of the printed web.

It is at this point that the invention departs from, and improves upon, the prior art. The software for the processor includes a register position generator 54 (see box 12) which provides a count for each repeat as the CI drum 15 rotates. For example, the register position generator might count from 0 to 1000 during each repeat. The count is reset to 0 at the beginning of each repeat. The beginning of each repeat is determined by the press position feedback 40. When the eyemark sensor 11 senses a register mark 48, the register position generator notes the count and sends that count to a summing junction 55.

When initial register is obtained, the operator pushes a button on the operator interface work station 35 which informs the processor to save the count for the next register mark 48 which is observed by the eyemark sensor 11. That count, for example, 200, is saved in the register command 56 (see box 12) and corresponds to initial register.

After the register command 56 is set, it can be adjusted by the operator via the operator interface work station 35. If the operator sees that the register between the first image 46 and second image 49 is off after the initial register is obtained and selected, he can modify the register command 56 by increasing or decreasing its value. The operator enters a plus or minus offset number (offsetting the register command) into the operator interface work station 35. The offset number is entered in inches. Therefore the operator need not understand the "0–1000" scaling.

As printing continues, the eyemark sensor 11 signals the register position generator every time it observes a register mark, and the register position generator 54 provides the count for that mark to the summing junction 55. The summing junction 55 compares the register command 56 for the count of the initial register with the actual count of the register mark. In the preferred embodiment, the register position generator 54 averages the counts for four consecutive register marks and sends the average count to the summing junction 55.

The summing junction 55 compares the count for the register mark(s), for example, 210, with the register command 56, which is 200 in the example, and sends the difference (+10) to a proportional integral (PI) regulator 57 which converts the signal to correspond to tension. The proportional integral (PI) regulator 57 also limits the tension trim signal such that the designed tension limits of the machine are not exceeded. A summing junction 58 compares the tension signal from the PI regulator with the base tension command which was originally set by the operator and sends an adjusting signal to the E/P converter 36 which adjusts the pressure of the dancer roll pneumatic cylinder 33 to adjust the tension of the web.

Increasing the tension of the web stretches the web and increases the length of the repeat of the first printed images 46 on the first side 47 of the web. Decreasing the tension decreases the repeat by allowing the web to snap back. The repeat of the first printed images 46 can therefore be adjusted so that it corresponds to the repeat of the second images 49 which are printed on the second side 50 of the web. The images on both sides of the web will therefore be in register.

In order to use minimal additional hardware, the register marks should be printed on a clear track on the web (i.e., a lane or strip of the web that does not include any other printed material in the longitudinal direction or web direction (as opposed to cross web direction)). However, the register marks could be printed on a non-clear track by using a register controller with gating capabilities, i.e., the ability to look for the register mark in a predefined window, longitudinal position, or length of the print repeat.

The hardware for the apparatus illustrated in FIG. 1 includes a microprocessor which is typically used for Flexographic presses, for example, a PiC 900 controller manufactured by Giddings & Lewis. The eyemark sensor can be a Sick Model NT8 contrast sensor. A suitable register control with gating capabilities is an Eltromat Model DRC 2000. The software which is represented by box 12 in FIG. 1 is within the capability of programmers for Flexographic presses, and additional details are not necessary.

Although the invention is particularly useful for printing a second printed image of the second side of a web where the first printed image is printed on the first side of the web, the second printed image can be printed on the first side of the web already printed with the first printed image.

Although we have described printing one register mark for each of the preprinted images, more or fewer register marks can also be used so long as the register marks are separated by a predetermined, fixed length. For example, two images can be printed for each register mark, called "two-up." However, this precludes the use of a gated register controller in general.

SUMMARY

A high speed input on an encoder card in the control processor (such as a Giddings & Lewis PiC 900) which interfaces to the eyemark sensor aids in determining register position of the web. The high speed input coupled with a hardware interrupt allows the control software to know the precise position of the register mark. The precise register position is measured with respect to position within a print repeat. The print repeat position is obtained from the position feedback on the press. This can be done with an encoder, resolver, or other similar device. The preferred method is to use the same feedback device that is on the servo motor of the press. The servo motor feedback is scaled for gear ratio. The feedback is further scaled to count pulses in a given repeat. The count should be reset to zero each repeat. The pulses should be scaled to give enough control resolution for the process. To control register to 1 mm, the pulse resolution should be 0.1 mm per pulse or finer.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A method of registering a plurality of second printed images with a plurality of preprinted first images on a flexible web in a printing press, the preprinted first images being separated by a repeat length, comprising the steps of:

applying a plurality of register marks on the web, the register marks being applied at a predetermined interval, winding the web into a roll, unwinding the web from the roll and advancing the web through a dancer assembly to a means for printing the web, the dancer assembly being the only means for controlling the tension of the web between the roll and the printing means, printing the web at the printing means with a plurality of second printed images while sensing the locations of the register marks, the second printed images being printed at intervals defined by a repeat length, comparing the relative positions of the register marks and the second printed images, and adjusting the dancer assembly to adjust the tension of the web to maintain said relative positions substantially constant.

2. The method of claim 1 in which the web includes first and second opposed surfaces, the first preprinted images being printed on one of the surfaces, and printing the second images on the other surface.

3. The method of claim 2 in which the register marks are applied to said one surface.

4. The method of claim 2 in which the register marks are applied to said one surface as the preprinted first images are printed on said one surface.

5. A method of registering a plurality of second printed images with a plurality of preprinted first images on a flexible web in a printing press comprising the steps of:

printing a plurality of first images on a web, the first images being printed at intervals defined by a first repeat length, printing a register mark on the web for each of the first images, the register marks being printed at intervals defined by said first repeat length, winding the web into a roll, unwinding the web from the roll and advancing the web through a dancer assembly to a means for printing the web, the dancer assembly being the only means for controlling the tension of the web between the roll and the printing means, printing the web with a plurality of second printed images while sensing the locations of the register marks, the second images being printed at intervals defined by a second repeat length, comparing the relative positions of the register marks and the second printed images, and adjusting the dancer assembly to adjust the tension of the web to maintain said relative positions substantially constant.

6. The method of claim 5 in which said tension-adjusting step stretches the web and makes the first repeat length substantially the same as the second repeat length.

7. A press for printing registered images on a web comprising:

unwind means for unwinding a roll of web material, means for printing a plurality of repeating register marks on the web so that the repeating register marks are printed at intervals defined by a repeat length, means for printing a plurality of repeating images on the web, means for sensing the positions of the register marks, means for sensing the positions of the images, means for comparing the positions of the register marks and the images, a dancer assembly positioned between the unwind means and the means for printing a plurality of repeating images on the web, the dancer assembly being the only means for controlling the tension of the web between the unwind means and the means for printing a plurality of repeating images on the web, and means for adjusting the dancer assembly so that the images are positioned consistently with respect to the register marks.

8. The press of claim 7 in which said adjusting means comprises a dancer roll assembly.

9. A method of registering a plurality of second printed images with a plurality of preprinted first images on a flexible web which is supported by a rotating cylinder in a printing press, the preprinted first images being separated by a repeat length, comprising the steps of:

moving the web past a sensor, generating a count which corresponds to the position of the rotating cylinder, applying a plurality of register marks on the web, the register marks being applied at a predetermined interval, printing the web with a second printed image, obtaining initial register between one of the preprinted first images and the second printed image, rotating the cylinder and the web so that a first register mark associated with said one preprinted first image is sensed by the sensor, storing a first count which corresponds to the position of the cylinder when said first register mark is sensed, continuing to print the web with a plurality of additional second printed images as the cylinder rotates, sensing additional register marks as the cylinder rotates, comparing said first count with additional counts which correspond to the positions of the cylinder when the additional register marks are sensed, and adjusting the tension of the web to reduce the difference between said first count and said additional counts.

10. The method of claim 9 in which a register mark is applied to the web for each of the first images, the register marks being separated by intervals defined by said repeat length.

11. A press for printing registered images on a preprinted web, the web being preprinted with first images thereon separated by a repeat length and a plurality of register marks separated by predetermined intervals, comprising:

means for unwinding a roll of said preprinted web, a rotatable cylinder for supporting the web, means for adjusting the tension of the web between said unwinding means and said cylinder, means for printing a plurality of repeating second images on the web when the web is supported by the cylinder, means for sensing the positions of the register marks, means for providing counts which correspond to the position of the cylinder when the register marks are sensed, means for storing a first count which corresponds to the position of the cylinder when a first register mark is sensed when one of the second images registers with one of the preprinted first images, means for comparing said first count with additional counts when additional register marks are sensed, means responsive to said means for comparing for sending a signal to said means for adjusting the tension of the web to reduce the difference between said first count and said additional counts.

12. The press of claim 11 in which said adjusting means comprises a dancer roll assembly.

* * * * *